US009433871B2

(12) United States Patent
Park

(10) Patent No.: US 9,433,871 B2
(45) Date of Patent: Sep. 6, 2016

(54) ASSEMBLY-TYPE TOY

(71) Applicant: Big Pumpkin Co., Ltd, Gwangju (KR)

(72) Inventor: Geun-Sik Park, Gyeonggi-do (KR)

(73) Assignee: Big Pumpkin Co., Ltd, Gwangju (KR)

( * ) Notice: Subject to any disclaimer, the term of this patent is extended or adjusted under 35 U.S.C. 154(b) by 0 days.

(21) Appl. No.: 14/437,500

(22) PCT Filed: Sep. 6, 2013

(86) PCT No.: PCT/KR2013/008058
§ 371 (c)(1),
(2) Date: Apr. 22, 2015

(87) PCT Pub. No.: WO2014/065505
PCT Pub. Date: May 1, 2014

(65) Prior Publication Data

US 2015/0258463 A1 Sep. 17, 2015

(30) Foreign Application Priority Data

Oct. 23, 2012 (KR) ..... 10-2012-0117880

(51) Int. Cl.
*A63H 33/04* (2006.01)
*A63H 33/08* (2006.01)
*A63H 33/10* (2006.01)

(52) U.S. Cl.
CPC ..... *A63H 33/08* (2013.01); *A63H 33/102* (2013.01); *A63H 33/106* (2013.01)

(58) Field of Classification Search
CPC ... A63H 33/04; A63H 33/046; A63H 33/042
See application file for complete search history.

(56) References Cited

U.S. PATENT DOCUMENTS 5,362,271 A * 11/1994 Butt ..... A63H 33/26 446/129
5,380,233 A * 1/1995 Numoto ..... A63H 3/46 403/59

(Continued)

FOREIGN PATENT DOCUMENTS

JP 06-031800 4/1994
JP 10-146467 6/1998

(Continued)

OTHER PUBLICATIONS

International Search Report Dated Dec. 18, 2013 From the Korean Intellectual Property Office Re. Application No. PCT/KR2013/008058 and Its Translation Into English.

*Primary Examiner* — Michael Dennis
*Assistant Examiner* — Urszula M Cegielnik

(57) ABSTRACT

The present invention relates to an assembly-type toy including: a toy main body; a toy main body connection means arranged in the toy main body, one side of which is inserted into another toy main body and the other side of which is provided to accommodate another toy main body; and a rotation support member which is arranged between the toy main body and the connection means and which is provided such that the connection means supports rotation from the one side to the other side. According to the present invention, a fastening part disposed in a toy block, one side of which accommodates the fastening part of another toy block and the other side of which is inserted into the fastening part of another toy block, is capable of interconnecting a plurality of toy blocks and is capable of relative rotation, and the fastening part that is not used for coupling is arranged inside the toy block so that a finally assembled toy can have a neat external appearance and be formed in a desired shape.

15 Claims, 29 Drawing Sheets

(56) References Cited

U.S. PATENT DOCUMENTS

| | | | | |
|---|---|---|---|---|
| 6,749,480 | B1 * | 6/2004 | Hunts | A63H 33/046 446/85 |
| 8,128,452 | B2 * | 3/2012 | Kim | A63H 33/046 446/129 |
| 2005/0164595 | A1 * | 7/2005 | Toht | A63H 33/046 446/92 |
| 2006/0111010 | A1 * | 5/2006 | Park | A63H 33/046 446/92 |
| 2006/0178081 | A1 * | 8/2006 | Daftari | A63H 3/46 446/92 |
| 2009/0017715 | A1 * | 1/2009 | Grichting | A63H 33/107 446/124 |
| 2009/0181595 | A1 * | 7/2009 | Song | A63H 33/046 446/92 |
| 2009/0197500 | A1 * | 8/2009 | Song | A63H 33/046 446/92 |
| 2010/0022158 | A1 * | 1/2010 | Kim | A63H 33/06 446/92 |
| 2010/0056014 | A1 * | 3/2010 | Tenorio | A63F 9/1204 446/92 |
| 2010/0075567 | A1 * | 3/2010 | Kim | A63H 33/046 446/92 |
| 2010/0120322 | A1 * | 5/2010 | Vicentelli | A63H 33/046 446/92 |
| 2011/0039474 | A1 * | 2/2011 | Bruder | A63H 33/101 446/124 |
| 2012/0270465 | A1 * | 10/2012 | Park | A63H 33/046 446/129 |
| 2013/0267145 | A1 * | 10/2013 | Rosen | A63H 33/046 446/92 |
| 2014/0213139 | A1 * | 7/2014 | Ferguson | A63H 33/046 446/92 |

FOREIGN PATENT DOCUMENTS

| | | |
|---|---|---|
| KR | 10-2010-0108653 | 10/2010 |
| KR | 10-2011-0004536 | 1/2011 |
| WO | WO 2014/065505 | 5/2014 |

* cited by examiner

ASSEMBLY-TYPE TOY

RELATED APPLICATIONS

This application is a National Phase of PCT Patent Application No. PCT/KR2013/008058 having International filing date of Sep. 6, 2013, which claims the benefit of priority of Korean Patent Application No. 10-2012-0117880 filed on Oct. 23, 2012. The contents of the above applications are all incorporated herein by reference.

FIELD AND BACKGROUND OF THE INVENTION

The present invention relates to an assembly-type toy, and in particular to an assembly-type toy wherein an engaging part is accommodated projectable form an outer side of a toy block, and a plurality of toy blocks may be interconnected to one another.

Background Art

In general, an assembly-type toy may be categorized into a type for finishing a desired toy with a predetermined shape by stacking a plurality of toy blocks, and a type for finishing a desired toy with a predetermined shape by engaging a plurality of toy blocks each having at least one or more than one engaging protrusion and a plurality of engaging grooves the number of which corresponds to the number of the engaging protrusions (hereinafter referred to as 'stacking-type toy').

In addition, there is another type of a toy wherein a plurality of toy blocks are engaged using an adhesive like a plastic model, thus finishing a previously set type of a finished toy (hereinafter referred to as 'engaging-type toy').

However, in case of the stacking-type toy, an engaging force between the neighboring toy blocks is weak, so the configuration of the finished toy may easily collapse down even when a slight external impact is exerted thereon after the toy is assembled into a predetermined shape. In addition, in case of the adhering-type toy, the finished toy cannot be disassembled once it is assembled into a finished toy, and even when the finished toy is disassembled, it is impossible to make another desired shape using the disassembled toy.

Therefore, the assembly-type toys in general usable for the development of kids intelligence, playing, etc. mainly is the engaging-type toy. Here, FIGS. 27 to 29 show various types of typical assembly-type toys which are disclosed in the Korean Patent Nos. 0250896, 0360083, and 0128830.

Referring to FIG. 27, it is confirmable that a toy block 110 is connected to another toy block 110 by inserting an engaging rod 130 into the toy block 110 which has a plurality of engaging holes 120. However, in this case, any effect may not be exerted on the engaging force in a state where the toy blocks are placed on the ground. When a user lifts up the toy block 110, the engaging rod 130 may gradually separate from the corresponding engaging hole 120, and the configuration that a plurality of the toy blocks 110 maintain may become unstable. In this case, if a user does a careless thing, a plurality of the toy blocks 110 may separate, thus collapsing down the previously assembled configuration.

FIG. 28 shows a toy block 210 wherein a plurality of insertion protrusions 220 and a plurality of connection holes 230 are formed on the surfaces at regular intervals. In this configuration, it is possible for a user to make a desired configuration in such a way to connect a toy block 210 with another one while matching the positions of the corresponding insertion protrusions 220 and connecting holes 230.

However, in case where it is intended to engage a plurality of toy blocks 210, the engaging force between the insertion protrusions 220 and the connecting holes 230 may become weak because of the increased weight of the toy blocks 210. If the increasing weight reaches a predetermined level of weight, they start to separate, so the previously assembled configuration may collapse down.

As illustrated in FIG. 29, there is provided an assembly-type toy wherein one surface thereof, a plurality of engaging protrusions 320 are arranged uniform at regular intervals, and on the other surface thereof, a plurality of engaging grooves 330 are arranged uniform at regular intervals. This configuration allows to increase the engaging force with the aid of a plurality of the engaging protrusion 320 and a plurality of the corresponding engaging grooves 330, however in case where a number of toy blocks 310 are intended to be engaged, the engaging force may become weak because of the increased weight.

In case of the assembly-type toy as illustrated in FIGS. 28 and 29, it is hard to arrange clean the insertion protrusions 220 or the engaging protrusions 320 which are not used for the assembly after the assembling is finished, entailing rough outer appearance and dirty states. In addition, a relative rotation is impossible between the toy blocks at the engaging part. In case of the assembly-type toy as illustrated in FIG. 27, if a rotation occurs between the neighboring toy blocks, the engaging rod 130 may slip, which makes it impossible for the engaging rod 130 to separate from the engaging hole 120.

For the above-described problems, a corresponding technical field needs to a develop a new assembly-type toy wherein it can withstand a heavy eight even if a plurality of toy blocks are connected, while maintaining a reliable engaging force between the toy blocks, and a relative rotation is possible between the toy blocks, and the outer appearance may look clean since the protruding portions can be made clean after the toy blocks are all assembled.

SUMMARY OF THE INVENTION

Technical Problem

Accordingly, the present invention is made in an effort to resolve the problems in the conventional art. It is an object of the present invention to provide an assembly-type toy wherein a plurality of toy blocks can be interconnected in such a way that one side of an engaging part provided in each toy block is configured to accommodate the engaging part of another toy block, and the other side thereof is configured to be inserted in the engaging part of another toy block, and at the same time, relative rotation is possible, and the engaging part which is not used for the engagement is arranged inside of the toy block, thus making clean the outer appearance of the finally assembled toy and obtaining a desired shape of the toy.

Solution to Problem

To achieve the above object, there is provided an assembly-type toy characterized in that a plurality of toy blocks can be interconnected in such a way that one side of an engaging part provided in each toy block is configured to accommodate the engaging part of another toy block, and the other side thereof is configured to be inserted in the engaging part of another toy block, and at the same time relative rotation is possible, and the engaging part which is not used for the engagement is arranged inside of the toy block, thus making clean the outer appearance of the finally assembled toy and obtaining a desired shape of the toy.

Advantageous Effects

In the assembly-type toy according to an exemplary embodiment of the present invention, an engaging part installed in each toy block by a simple rotation may become a part into which an engaging part of another toy block is inserted or may become a part which is accommodated by an engaging part of another toy block, so a plurality of toy blocks may be easily assembled without any limits in the shapes which are intended to be engaged.

In addition, a relative rotation between the engaged toy locks can allows to provide various functions, and the engaging part which is not used for engagements may be accommodated inside of the toy block, so the outer appearance of the finally assembled toy may look clean, thus obtaining a desired shape of the toy.

DESCRIPTION OF SPECIFIC EMBODIMENTS OF THE INVENTION

Figure 1:
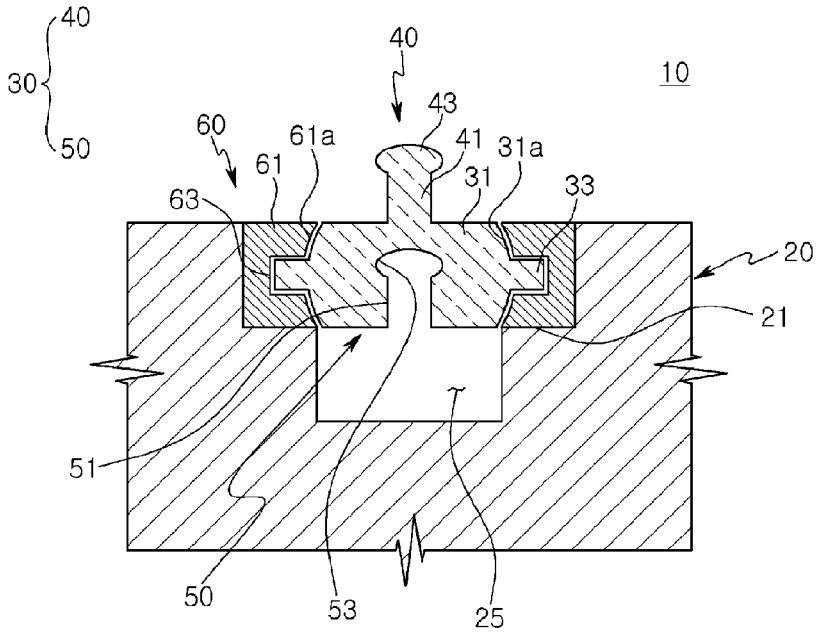
FIG. 1 is a side cross sectional view illustrating a state where an insertion part protrudes outward according to a first exemplary embodiment of the present invention.

According to an exemplary embodiment of the present invention, there is provided an assembly-type toy, which may include a toy main body; and one or more than one connection unit which is installed rotatable at the toy main body and includes an insertion part and an accommodation part which are provided for the sake of a connection and assembling of the toys.

According to an exemplary embodiment, a connection and assembling of the toys can be obtained in such a way that the insertion part of the connection unit is inserted in the accommodation part of the connection unit provided at another toy or the insertion part of the connection unit provided at another toy is inserted in the accommodation part of the connection unit.

According to an exemplary embodiment, there is further provided a rotation support member which is provided at the toy main body so as to support the rotations of the connection unit.

According to an exemplary embodiment, the connection unit includes a body bock at one side of which the insertion part is formed, and at the other side of which the accommodation part is formed; and a rotary shaft part which is provided at both sides of the body block and is inserted in the rotation support member, thus enabling the body block to rotate.

According to an exemplary embodiment, the insertion part includes a protrusion block which protrudes from one side of the body block, and the accommodation part includes an engaging groove formed at the other side of the body block for thereby receiving the protrusion block.

According to an exemplary embodiment, the insertion part includes a cap member provided at an outer end of the protrusion block, and the accommodation part includes an engaging shoulder part which is provided at an inner side of the engaging groove, so the cap member is caught thereby.

According to an exemplary embodiment, the cap member is made of an elastic material for the sake of easier assembling to or easier separation from the engaging shoulder part.

According to an exemplary embodiment, there are further provided a first magnetic force member which is installed at the cap member so as to form one magnetic pole in the magnetic force; and a second magnetic force member which is installed at the engaging shoulder part so as to form the other magnetic pole which is different from that of the first magnetic force member, in order to cooperate with the first magnetic force member.

According to an exemplary embodiment, the rotation support member includes a body block which covers the circumference of the body block of the connection unit and is mounted in the engaging part of the toy main body; and a rotary shaft support part which is provided on a contact surface with the body block in the main body block and into which the rotary shaft part is inserted and which supports the rotations of the body block.

According to an exemplary embodiment, there is further provided a multiple-direction moving unit which is disposed between the rotation support member and the toy main body so as to enable the rotation support member to move in multiple directions.

According to an exemplary embodiment, the multiple-direction moving unit includes a first guide groove part which is disposed in a circumferential direction of the main body block in the toy main body; and a first extension part which is installed at an outer circumference of the main body block and is mounted in the first guide groove part and moves along the first guide groove part and enables the main body block to rotate in a circumferential direction.

According to an exemplary embodiment, the multiple-direction moving unit includes a second guide groove part which is provided in a track shape at a periphery of the main body block in the toy main body; and a second extension part which is installed along an outer circumference of the main body block and is mounted in the second guide groove part and enables the main body block to move along a track shape of the second guide groove part.

Modes for Carrying out the Invention

For helping the better understanding of the features of the invention, the assembly-type toy according to an exemplary embodiment of the present invention will be described in detail.

For the reference numbers indicated in the drawings attached to help the better understanding of the exemplary embodiment, which will be descried later, specific components among the related components having the same operations in each exemplary embodiments may be indicated with the same or equivalent numbers.

It is noted that the exemplary embodiments of the present invention are based on the facts that a plurality of toy blocks can be interconnected in such a way that one side of an engaging part provided in each toy block is configured to accommodate the engaging part of another toy block, and the other side thereof is configured to be inserted in the engaging part of another toy block, and at the same time, relative rotation is possible, and the engaging part which is not used for the engagement is arranged inside of the toy block, thus making clean the outer appearance of the finally assembled toy and obtaining a desired shape of the toy.

The exemplary embodiments of the present invention will be described in detail with reference to the accompanying drawings.

Figure 2:
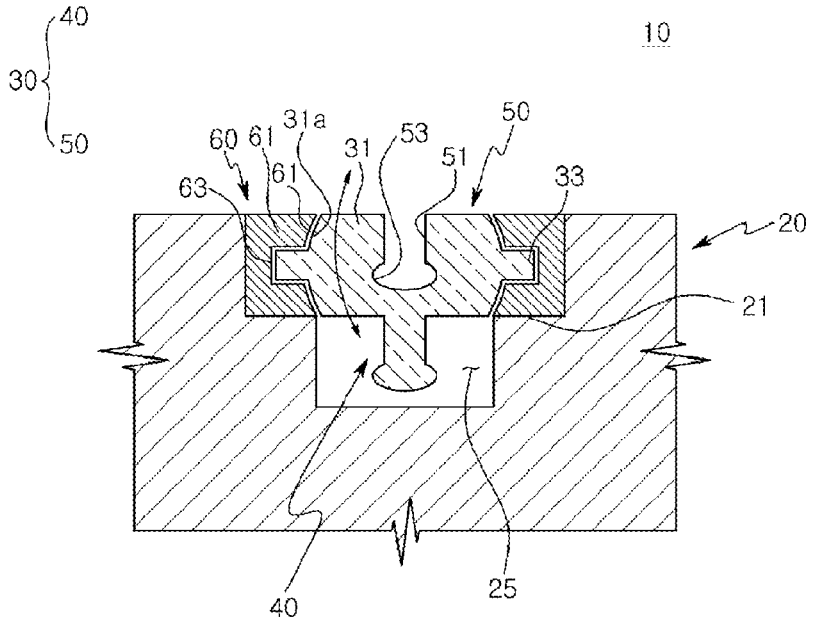
FIG. 2 is a side cross sectional view illustrating a state where an accommodation part protrudes outward after it rotates 180° in the present invention in FIG. 1.
Figure 3:
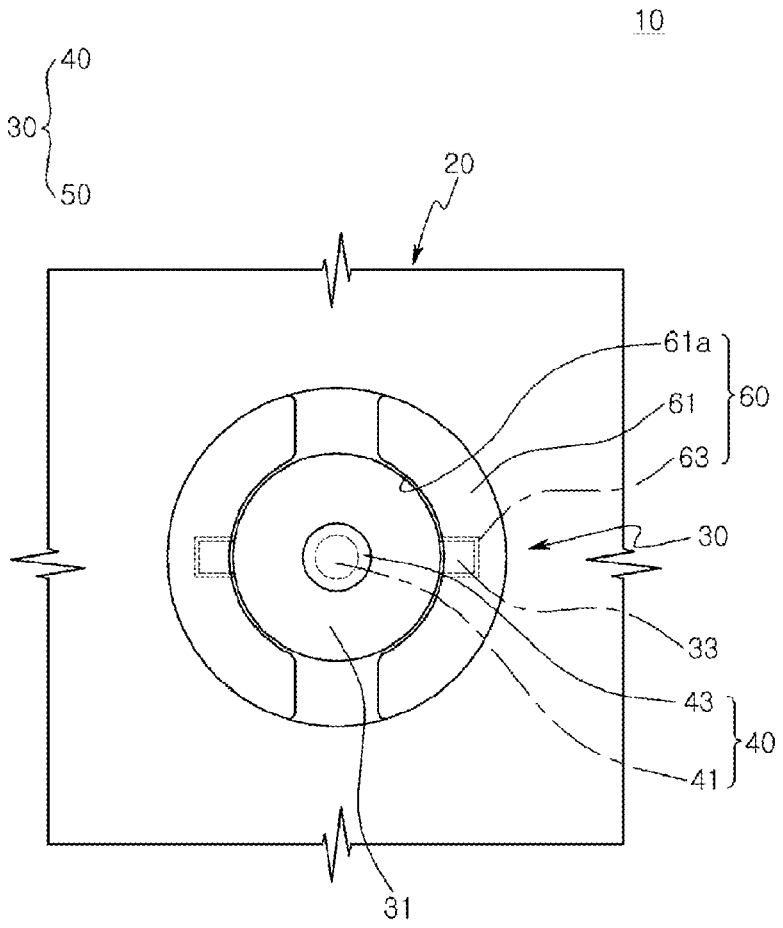
FIG. 3 is a plane view illustrating a state where an insertion part protrudes outward in the invention in FIG. 1.
Figure 4:
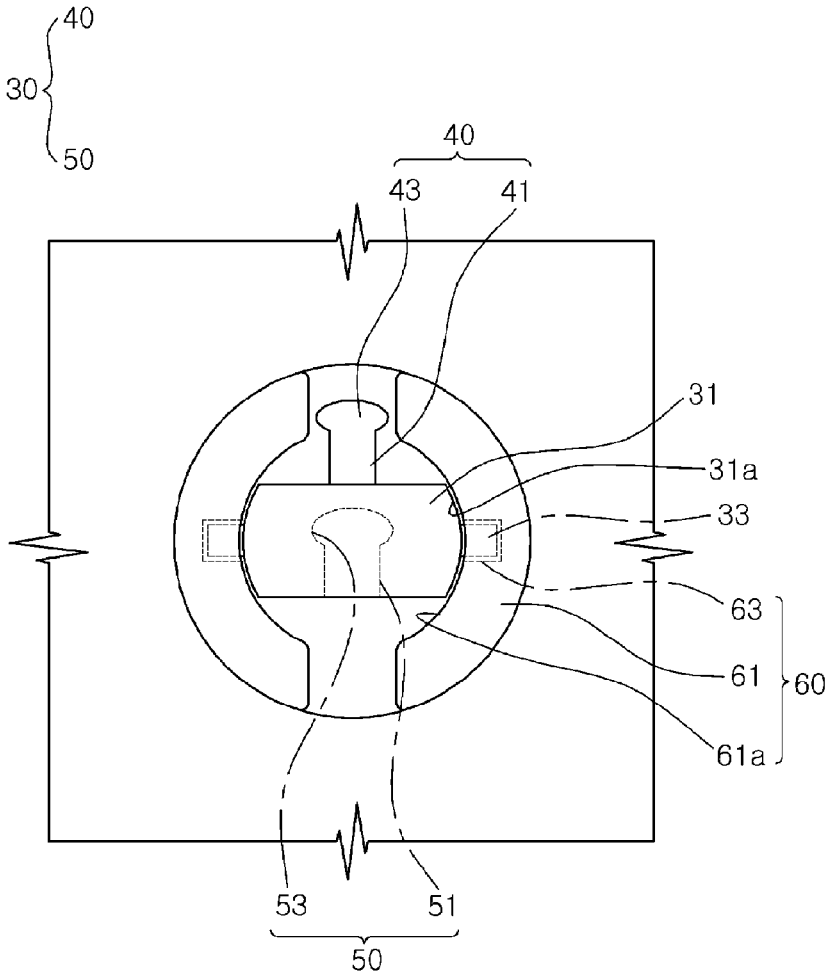
FIG. 4 is a plane view illustrating a state where an insertion part rotates 90° in the invention in FIG. 3.
Figure 5:
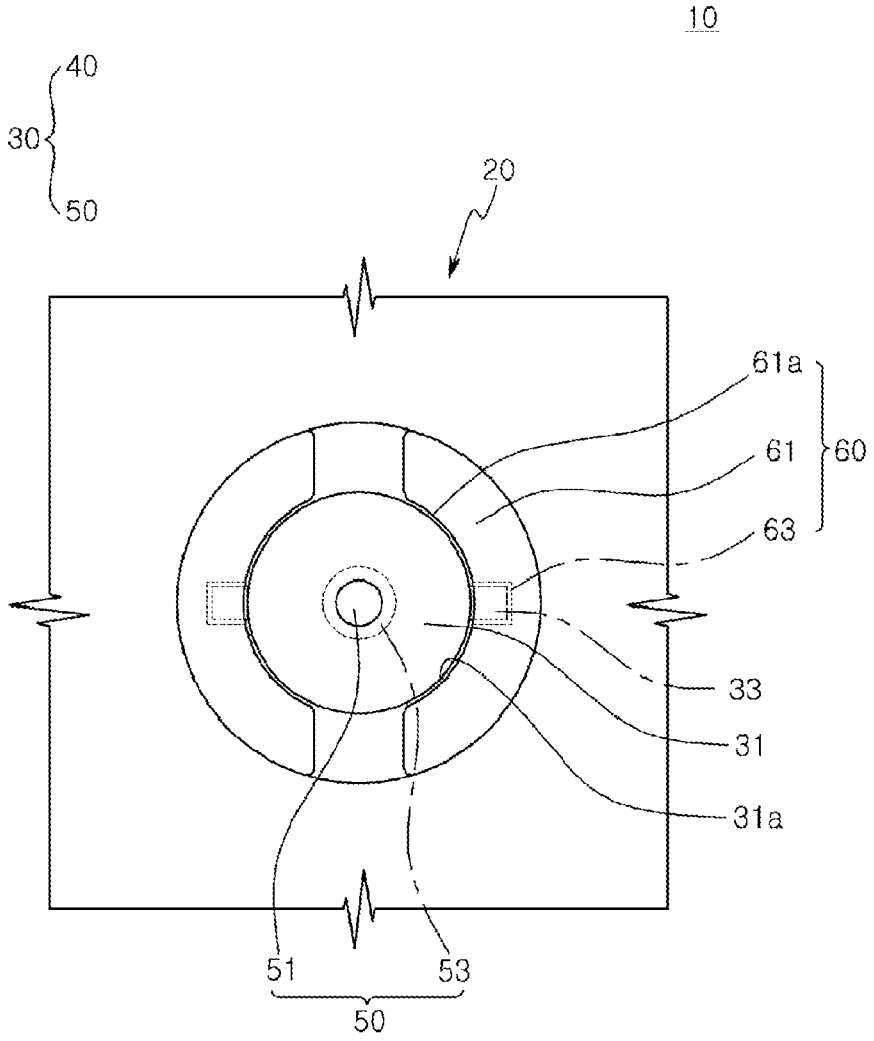
FIG. 5 is a plane view illustrating a state where an accommodation part protrudes outward in the invention in FIG. 2.
Figure 6:
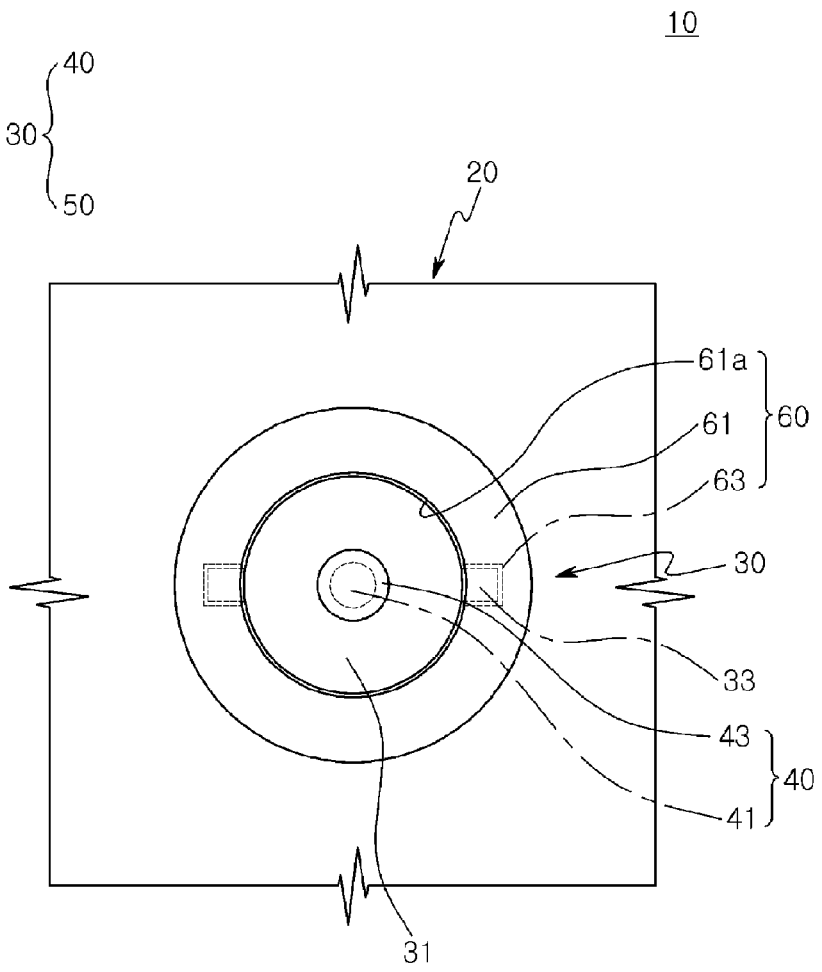
FIGS. 6, 7 and 8 are plane views illustrating another exemplary embodiment which is different from a rotation support member in FIGS. 3 to 5.
Figure 7:
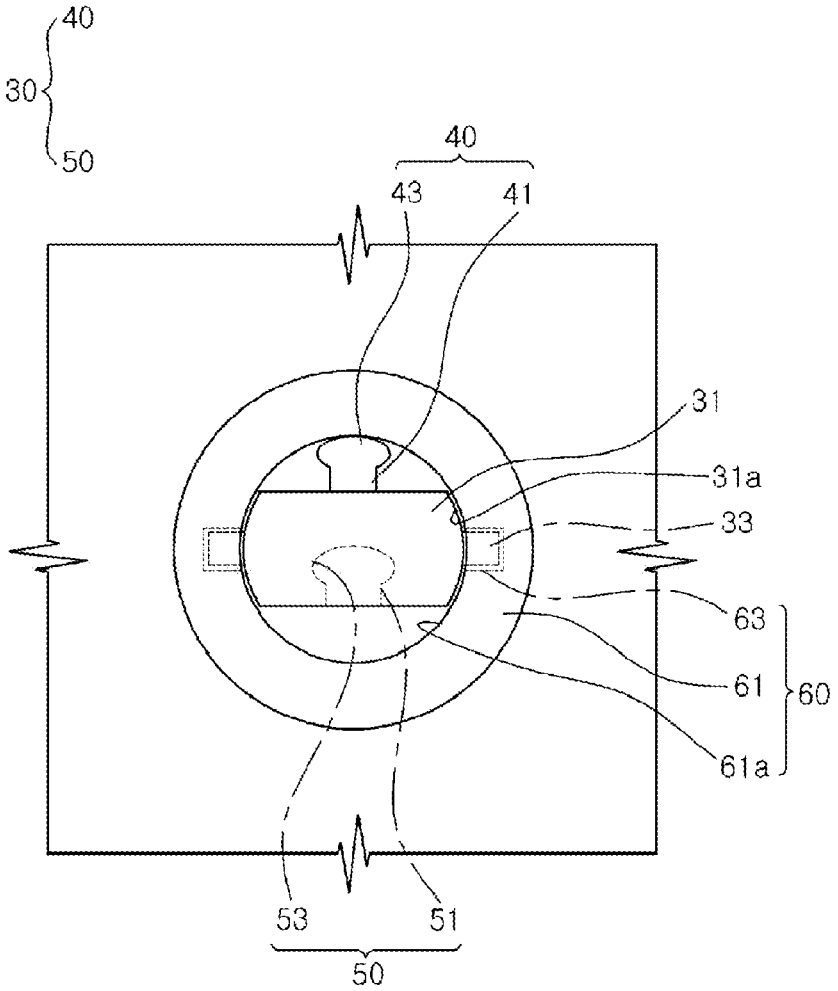
Figure 8:
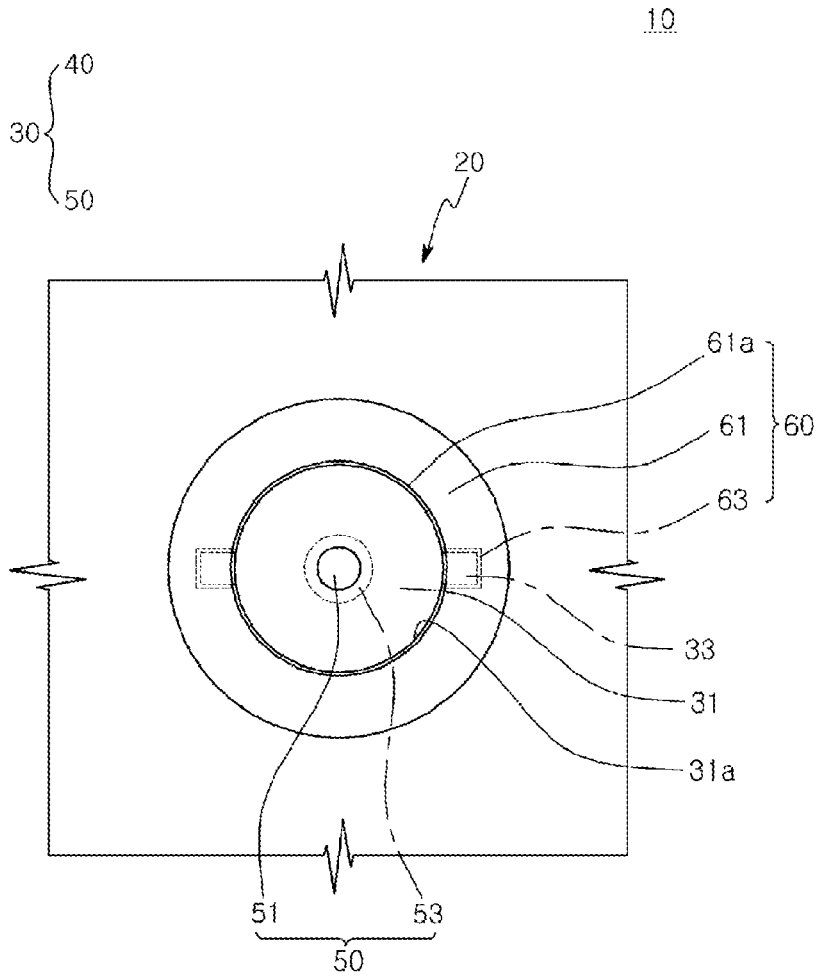
Figure 9:
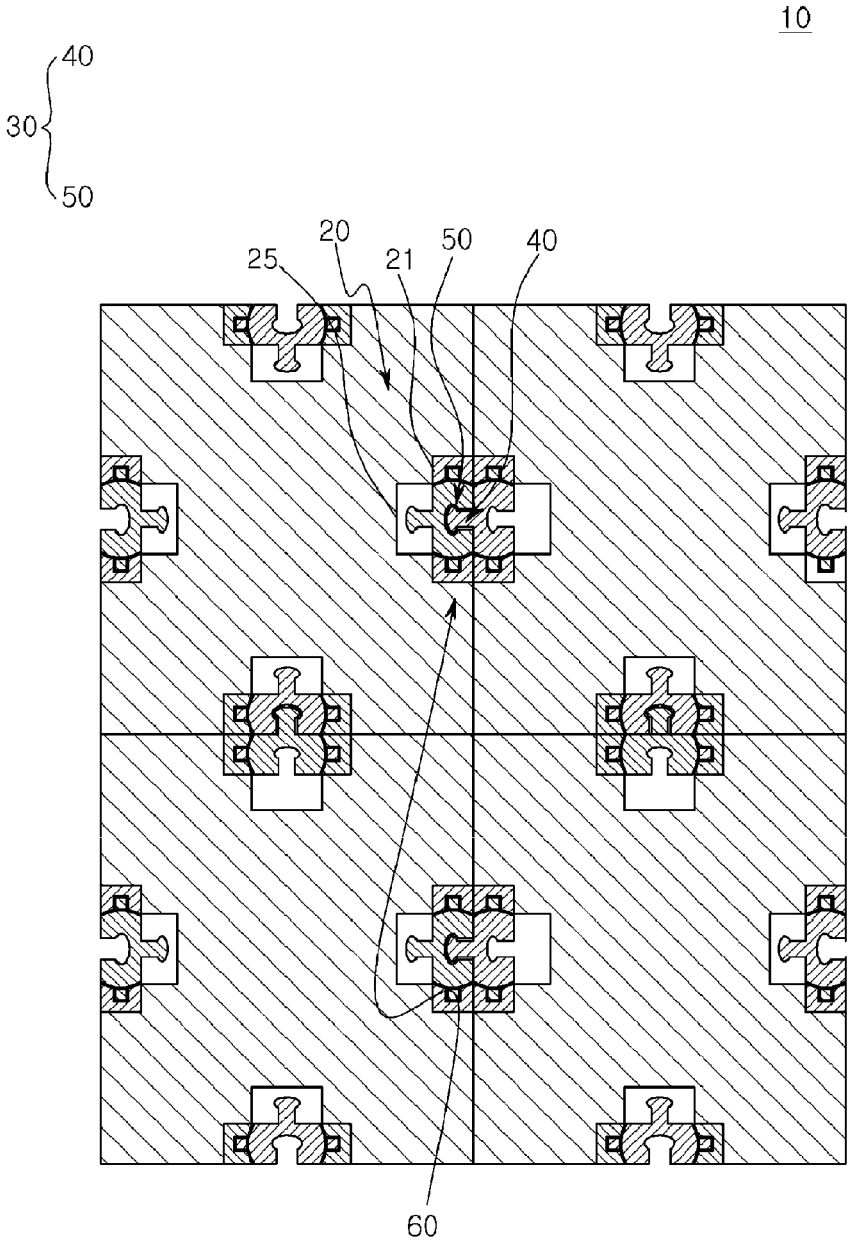
FIG. 9 is a side cross sectional view illustrating a state where a plurality of toy bodies are interconnected to each other in the invention in FIGS. 1 and 2.

FIG. 1 is a side cross sectional view illustrating a state where an insertion part protrudes outward according to a first exemplary embodiment of the present invention. FIG. 2 is a side cross sectional view illustrating a state where an accommodation part protrudes outward after it rotates 180° in the present invention in FIG. 1. FIG. 3 is a plane view illustrating a state where an insertion part protrudes outward in the invention in FIG. 1. FIG. 4 is a plane view illustrating a state where an insertion part rotates 90° in the invention in FIG. 3. FIG. 5 is a plane view illustrating a state where an accommodation part protrudes outward in the invention in FIG. 2. FIGS. 6 to 8 are plane views illustrating another exemplary embodiment which is different from a rotation support member in FIGS. 3 to 5. FIG. 9 is a side cross sectional view illustrating a state where a plurality of toy bodies are interconnected to each other in the invention in FIGS. 1 and 2.

Referring to FIGS. 1 to 9, the assembly-type toy according to a first exemplary embodiment of the present invention may include a toy main body 20, and at least one connection unit 30 which is provided rotatable at the toy main body 20 and serves to allow to connect and assemble the toys, wherein the connection unit may include an insertion part 40 and an accommodation part 50.

Here, the connection and assembling of the toys may be obtained in such a way that the insertion part 40 of the connection unit 30 is inserted in the accommodation part of the connection unit provided in another toy or the connection and assembling of the toys may be obtained in such a way that the accommodation part 50 of the connection unit 30 accommodates the insertion part of the connection unit provided in another toy.

In addition, there may be further provided a rotation support member 60 which is disposed between the toy main body 20 and the connection unit 30, thus enabling the connection unit 30 to rotate from one side to the other side.

At this time, the toy main body 20 may be made of a material such as plastic, unsawn timber, etc. and may be provided in various 3D shapes, such as a circular shape, an elliptical shape, a polygonal shape, etc.

In addition, the connection unit 30 may include a body block 31, an insertion part 40, an accommodation part 50 and a rotary shaft part 33. Here, the rotation support member 60 may include a main body block 61 and a rotary shaft support part 63.

First, the body block 31 may be provided in a cylindrical shape which has a first curved part 31*a* the top and bottom of which are flat, and the height of which is bulged in a circumferential direction. The insertion part 40 may be arranged on one surface of the body block 31.

Here, the insertion part 40 may include a protrusion block 41, and a cap member 43. The protrusion block 41 may be arranged, protruded in an outward direction from one surface of the body block 31. In addition, the cap member 43 may be provided at an outer end of the protrusion block 41. The cap member 43 may be provided, bulged in a circumferential direction from the protrusion block when viewing from the cross section thereof.

In addition, the accommodation part 50 may be provided on the other surface of the body block 31. The accommodation part 50 may include an engaging groove 51 and an engaging shoulder part 53. The engaging groove 51 may be arranged, sunk in an inward direction from the other surface of the body block 31, and the protrusion block 41 of another toy main body may be inserted therein.

The engaging shoulder part 53 may be provided at an inner end of the engaging groove 51, and the engaging shoulder part 53 may be provided, sunk in a concave shape corresponding to the shape bulged and protruding in the circumferential direction of the cap member 43. At this time, engaging force may occur when the cap member 43 gets caught by the engaging shoulder part 53, so a plurality of the toy bodies 20 may be interconnected.

Here, for the sake of an easier attachment and detachment between the cap member 43 and the engaging shoulder part 53, the cap member 43 may be made of an elastic material. In this case, since the cap member 43 has an elastic force, the cap member 43 is compressed when passing past the protrusion block 41 and expands when it reaches the engaging shoulder part 53, so the cap member 43 can get caught by the engaging shoulder part 53. Of course, the cap member 43 and the protrusion block 41 and the body block 31 may be all made of an elastic material, such as rubber, silicon, etc.

In addition, the rotary shaft part 33 may be installed at a part of the outer circumference of the body block 31 and is engaged to the rotary shaft support part 63 provided on the inner surface of the main body block 61. The rotary shaft support part 63 is arranged on the contact surface with the body block 31 in the main body block 61 and is engaged with the rotary shaft part 33, thus stably supporting the rotations of the body block 31.

Here, the main body block 61 of the rotation support member 60 may be provided in a ring shape to cover the circumference of the body block 31, and the inner surface of the main body block 61 may be provided with a second curved part 61*a* which is curved in a concave shape corresponding to the configuration of a first curved part 31*a* formed on an outer surface of the body block 31. So, the main body block 61 may have a smooth rotation without separating from the body block 31. The main body block 61 may be fixedly attached to an engaging part 21 of the toy main body 20.

As illustrated in FIGS. 3 to 5, the main body block 61 may be configured in such a way that a pair of the main body blocks 61 are separated and are fixed at the toy main body so as to support the body block 31 or as illustrated in FIGS. 6 to 8, a pair of main body blocks 61 may be adhered to each other, thus forming a single body in a ring shape and supporting the body block 31. In this case, the height of the protrusion block 41 provided on the body block 31 is smaller than the inner radius of the main body block 61, so the body block can rotate inside of the main body block.

At this time, the toy main body 20 may include an engaging part 21 cut-away so as to fixedly mount the main body block 61, and a storing part 25 which is cut-away with a height gap from the engaging part and allows to store the protrusion block 41 and the cap member 43 when the body block 31 rotates.

Referring to FIGS. 1 and 2, when a user rotates the body bock 31 by 180° in a state where the insertion part 40 protrudes outward, it can be confirmed that the insertion part 40 is stored inside of the toy main body 20. In this way, the user can connect multiple toy blocks, as illustrated in FIG. 9, while properly adjusting the positions of the insertion part 40 and the accommodation part 50 both installed at the multiple toy bodies 20.

Figure 10:
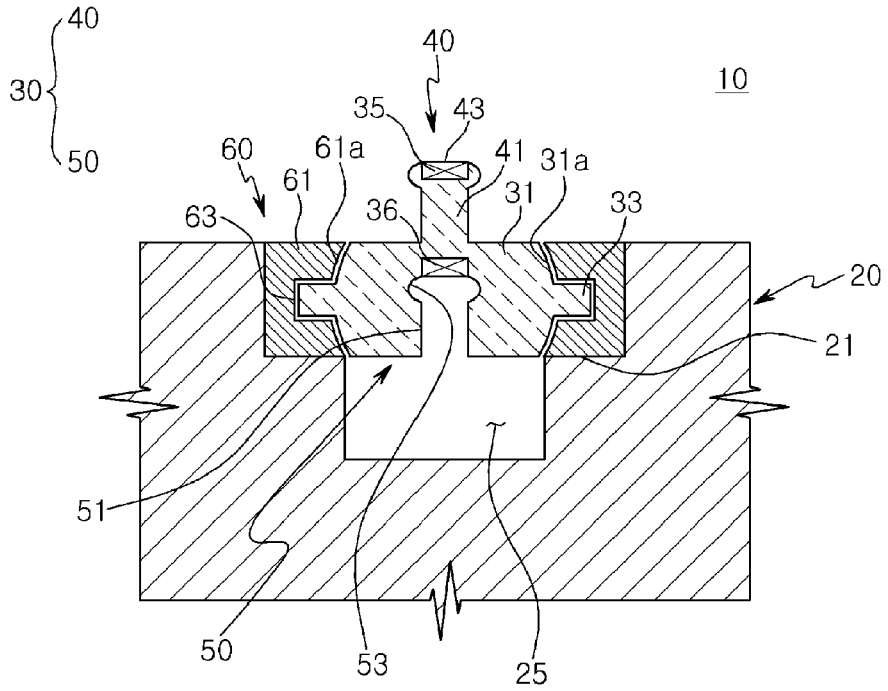
FIG. 10 is a side cross sectional view illustrating a state where first and second magnetic force members are arranged according to a first exemplary embodiment of the present invention.

Meanwhile, according to the exemplary embodiment of the present invention, as illustrated in FIG. 10, the connection unit 30 may further include first and second magnetic force members 35 and 36 so as to reinforce the engaging force between the connected toy bodies 20.

More specifically, the first magnetic force member 35 may be installed on the top of the cap member 43 so as to form and provide one magnetic pole in the magnetic force. In addition, the second magnetic force member 36 may be installed on the top of the engaging shoulder part 53, thus forming and providing the other magnetic pole being different from that of the first magnetic force member 35 for the sake of cooperation with the first magnetic force member 35.

In case when the first and second magnetic force members 35 and 36 are further provided, since the engaging force deriving from the magnetic force can be additionally obtained together with the engaging force obtained tanks to the configurations of the cap member 43 and of the engaging shoulder part 53, it is possible to continuously maintain the shape in such a way to reinforce the engaging force between the neighboring toy bodies 20 when making the final shape toy like a vehicle, an airplane, etc.

Figure 11:
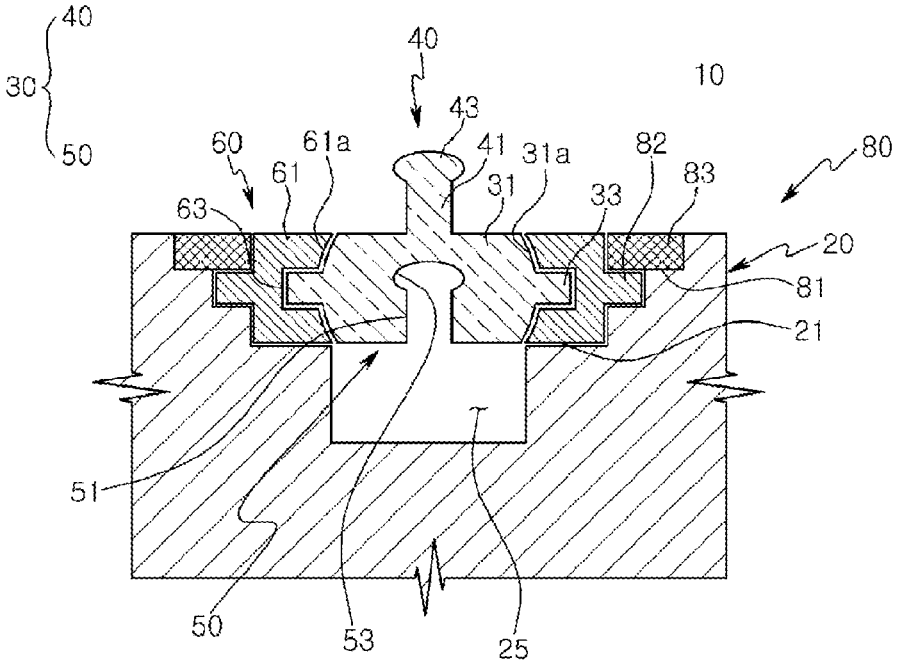
FIG. 11 is a side cross sectional view of a second exemplary embodiment of the present invention.
Figure 12:
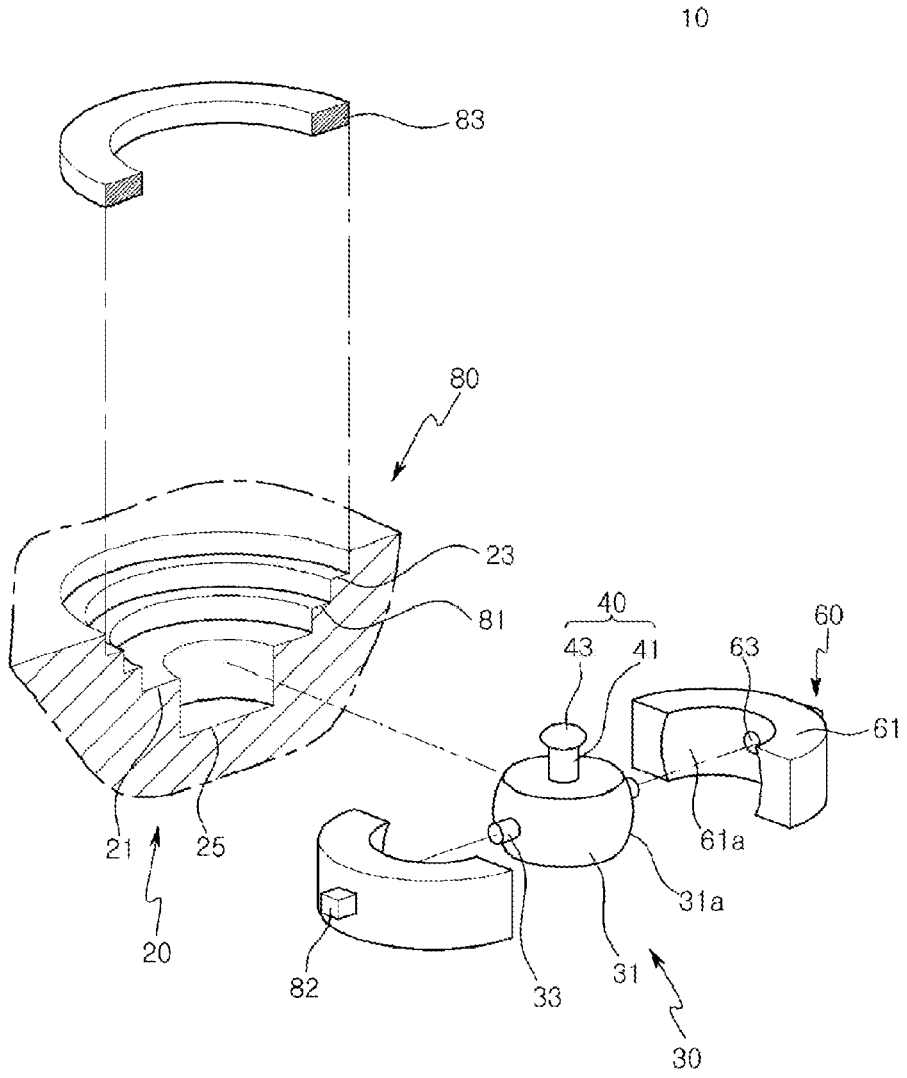
FIG. 12 is a view illustrating an assembled state of the invention in FIG. 11.
Figure 13:
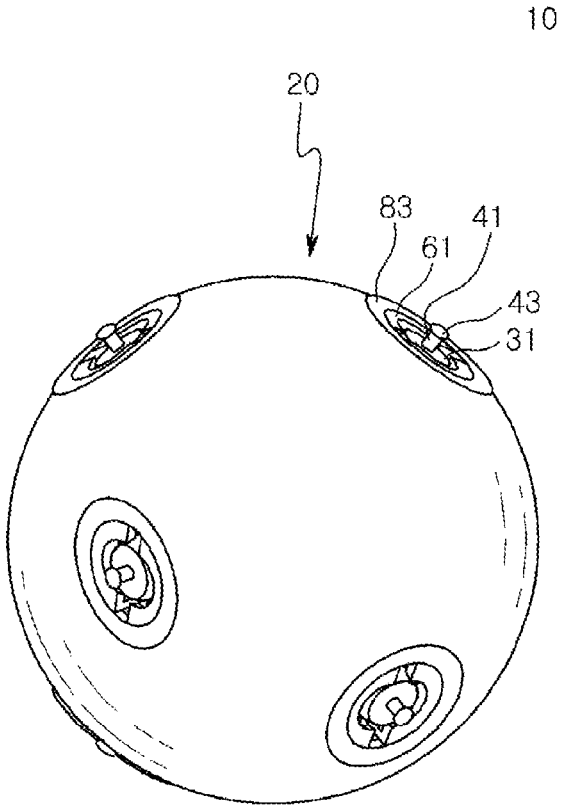
FIGS. 13, 14, 15, 16, 17, 18 and 19 are perspective views illustrating various forms of a toy main body to which the invention in FIG. 11 applies.
Figure 14:
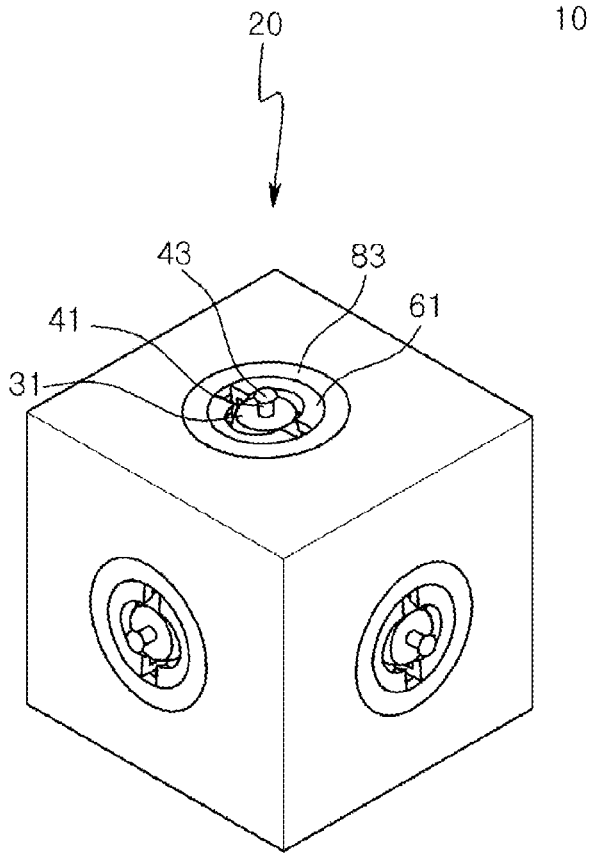
Figure 15:
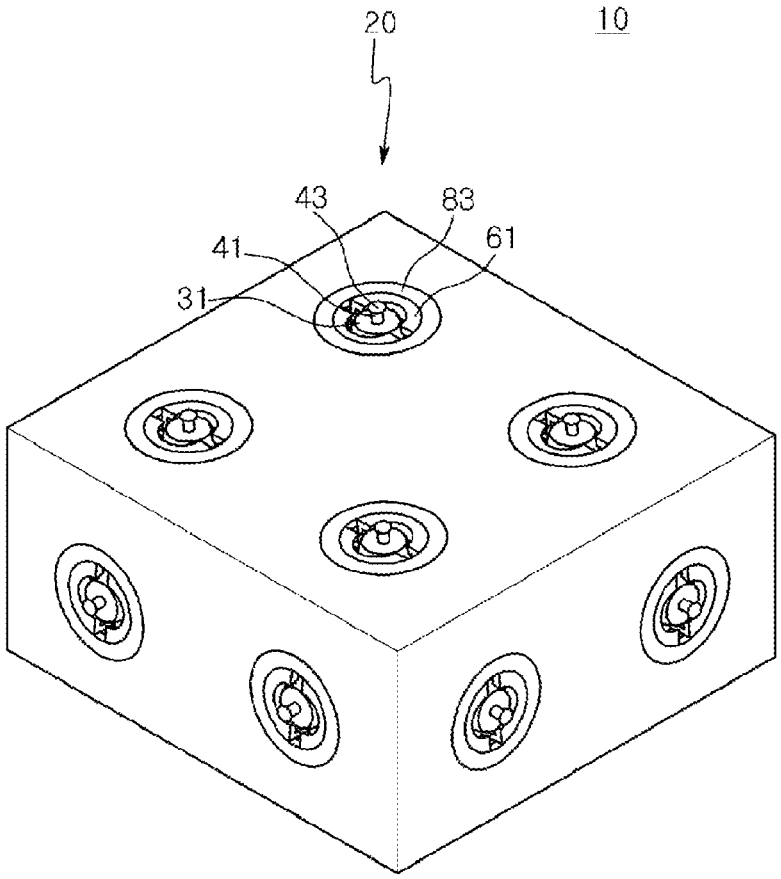
Figure 16:
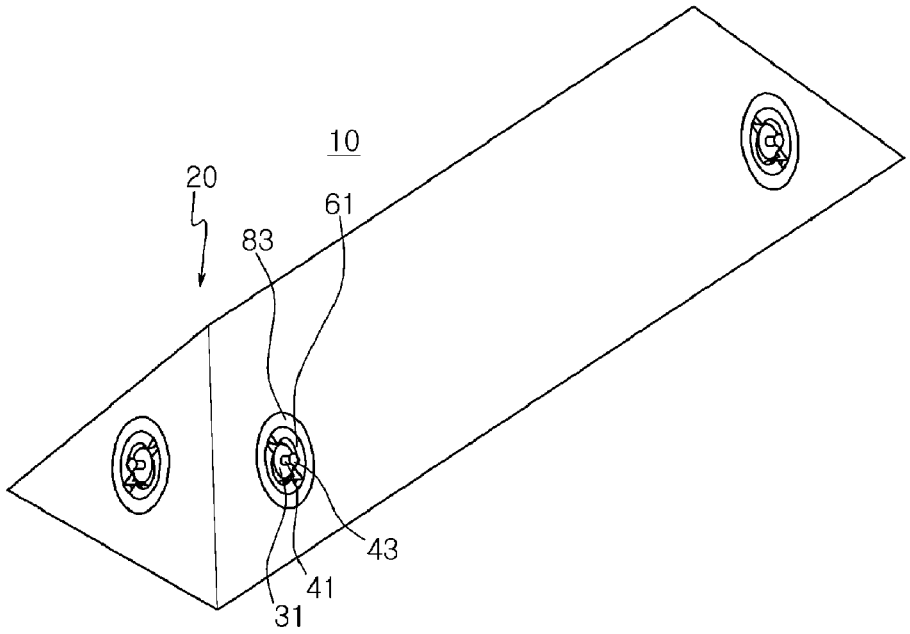
Figure 17:
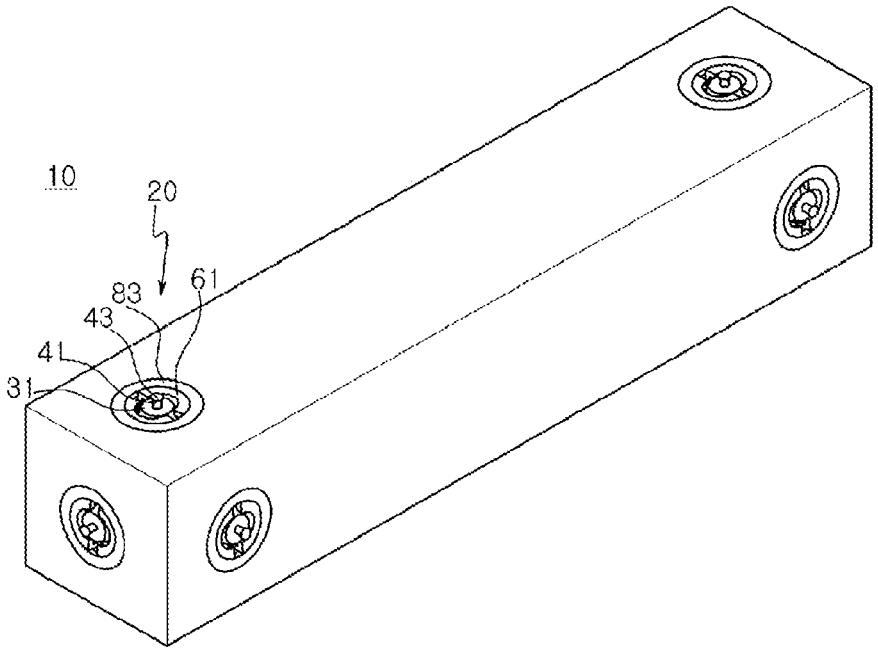
Figure 18:
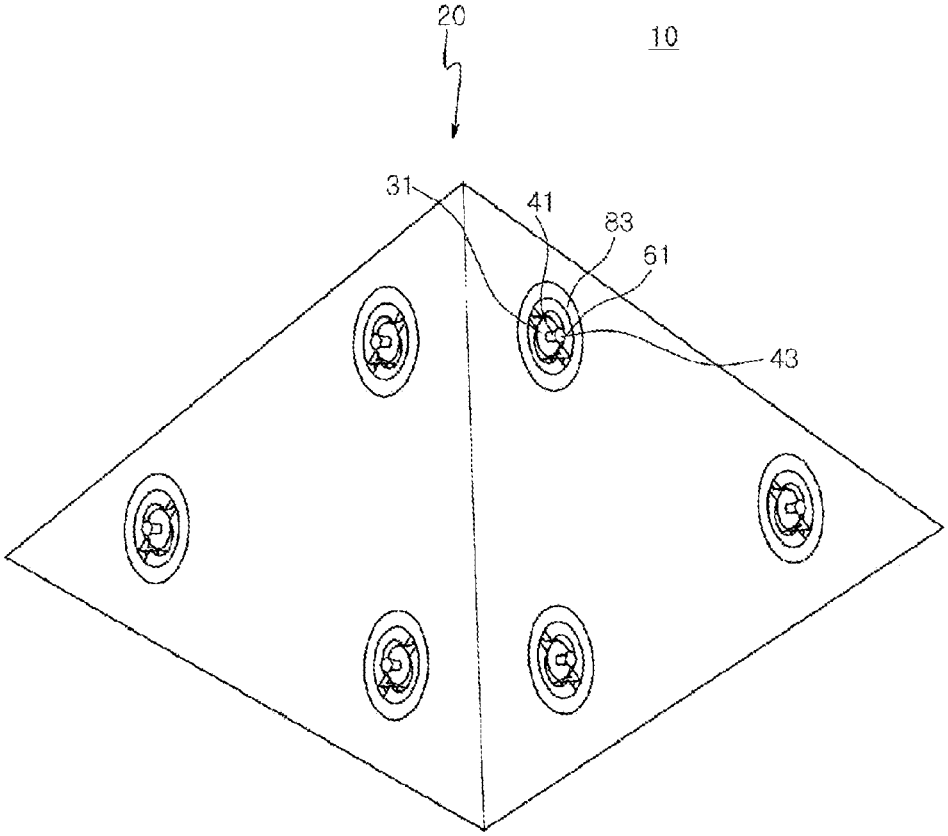
Figure 19:
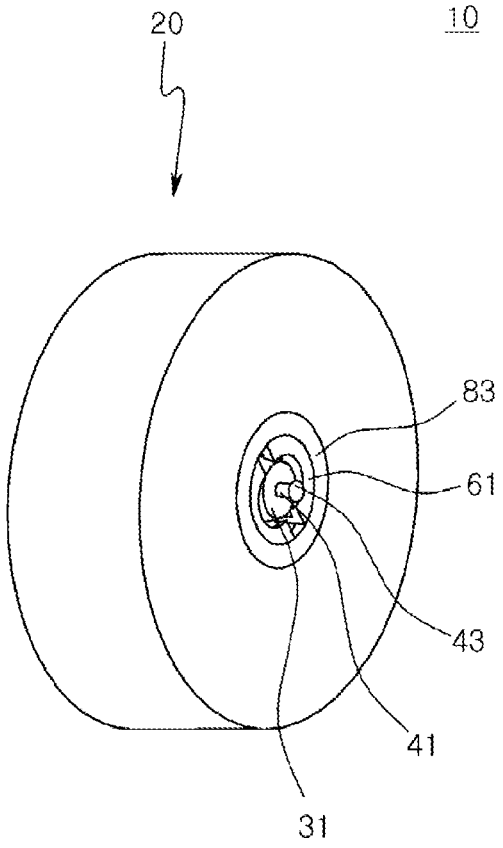
Figure 20:
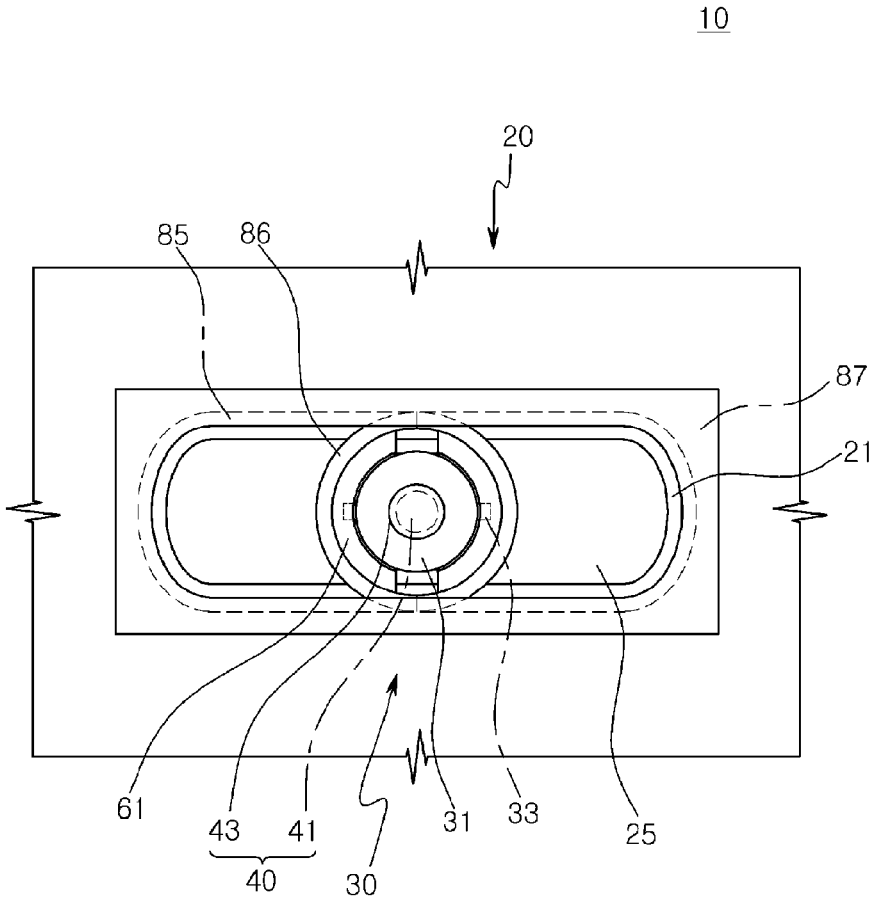
FIG. 20 is a plane view of a third exemplary embodiment of the present invention.
Figure 21:
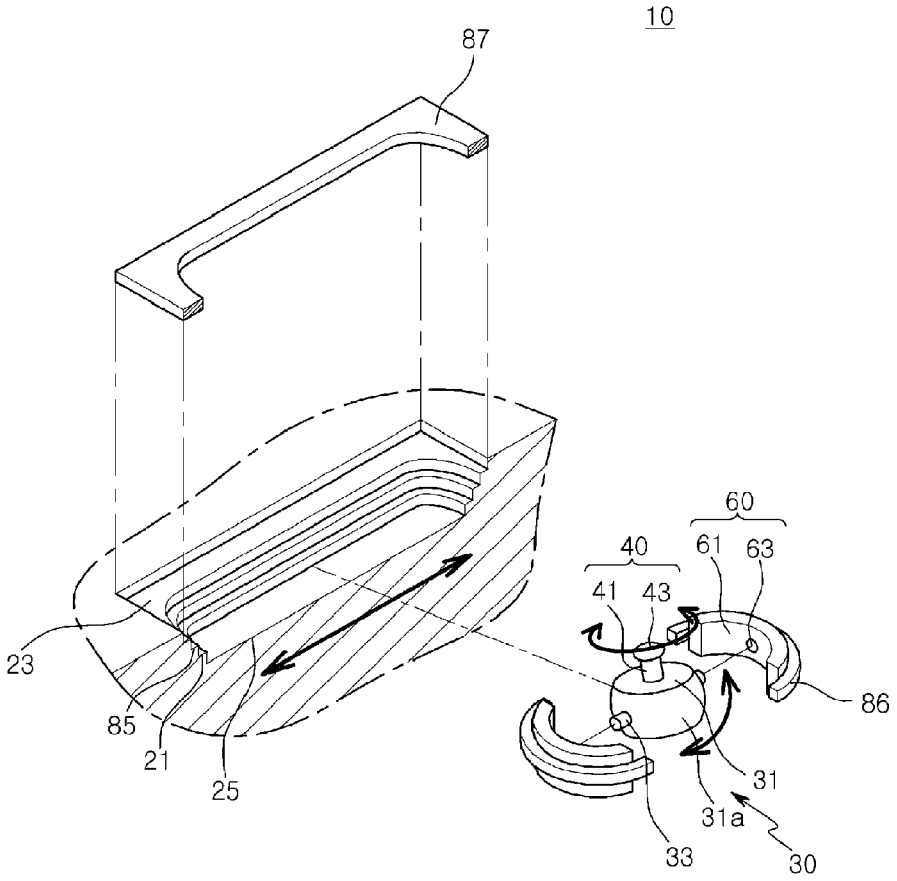
FIG. 21 is a view illustrating an assembled state of the invention in FIG. 20.
Figure 22:
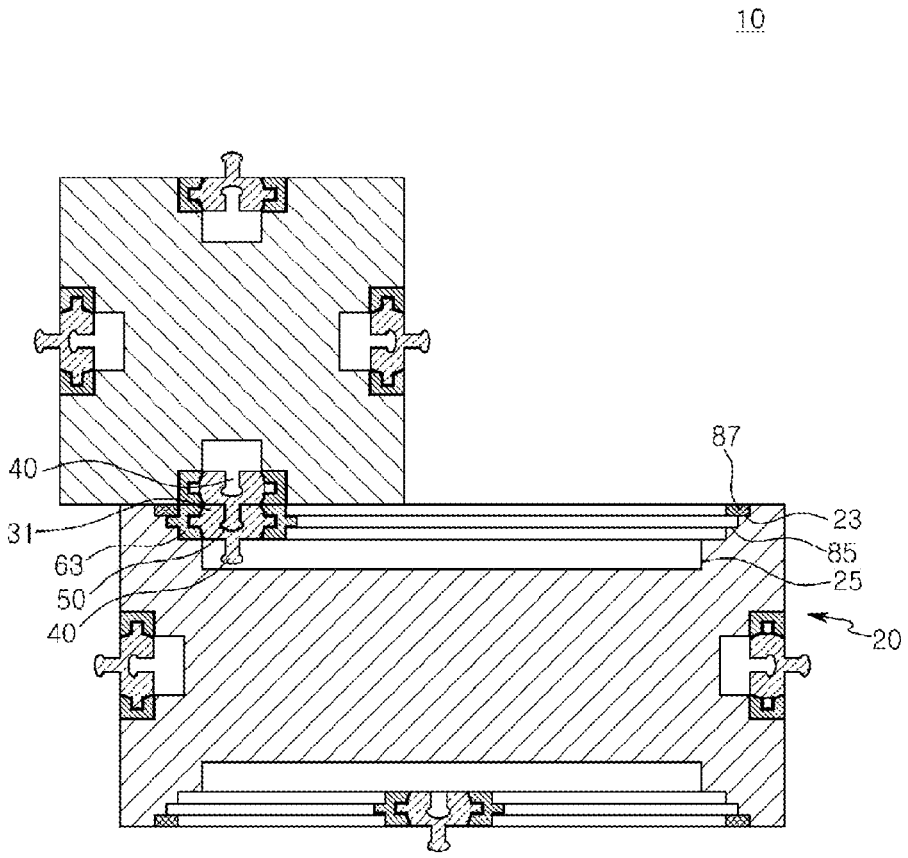
FIG. 22 is a side cross sectional view of the invention in FIG. 20.
Figure 23:
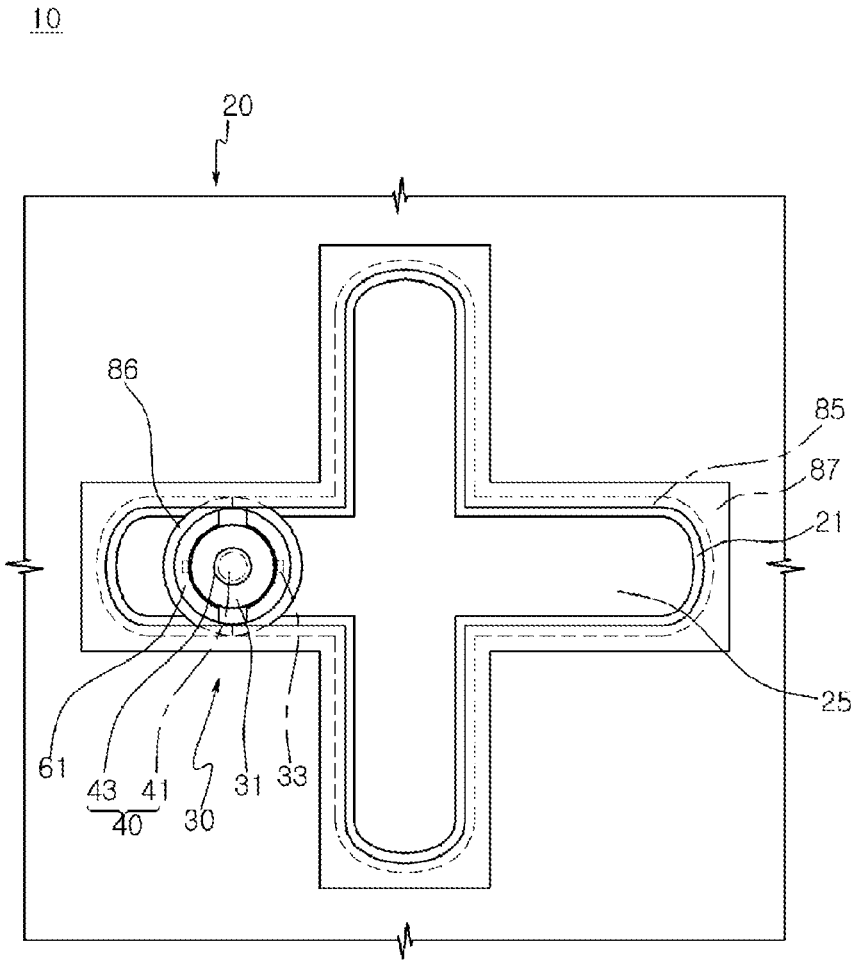
FIG. 23 is a plane view illustrating a state where a second guide groove part is arranged in a cross shape in the invention in FIG. 20.
Figure 24:
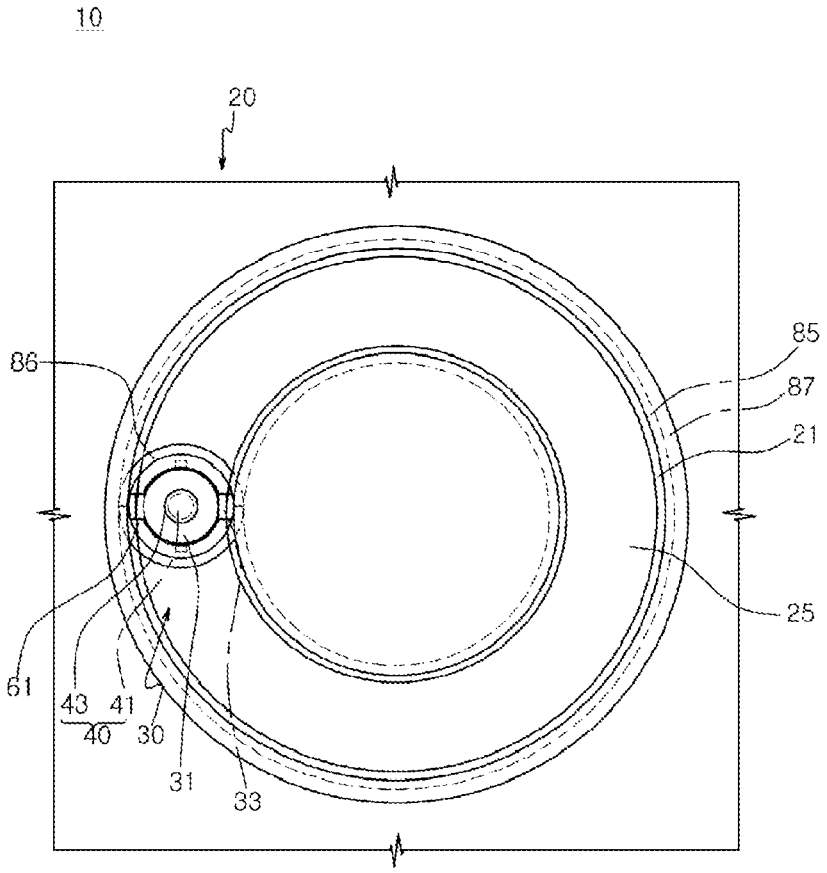
FIG. 24 is a plane view illustrating a state where a second guide groove part is arranged in a circular shape or an eclipse shape in the invention in FIG. 20.

Meanwhile, FIG. 11 is a side cross sectional view of a second exemplary embodiment of the present invention. FIG. 12 is a view illustrating an assembled state of the invention in FIG. 11. FIGS. 13 to 19 are perspective views illustrating various forms of a toy main body to which the invention in FIG. 11 applies. FIG. 20 is a plane view of a third exemplary embodiment of the present invention. FIG. 21 is a view illustrating an assembled state of the invention in FIG. 20. FIG. 22 is a side cross sectional view of the invention in FIG. 20. FIG. 23 is a plane view illustrating a state where a second guide groove part is arranged in a cross shape in the invention in FIG. 20. FIG. 24 is a plane view illustrating a state where a second guide groove part is arranged in a circular shape or an eclipse shape in the invention in FIG. 20.

Referring to FIGS. 11 to 22, the assembly-type toy according to another exemplary embodiment of the present invention may include a toy main body 20, a toy main body connection unit 30 which is provided at the toy main body 20 and one side of which is inserted in the engaging part of another toy main body 20, and the other side of which allows to accommodate the engaging part of another toy main body 20, a rotation support member 60 which is disposed between the toy main body 20 and the connection unit 30 and serves to support the rotations of the connection unit 30 from one side to the other side, and a multiple-direction moving unit 80 which is disposed between the rotation support member 60 and the toy main body 20 in order for the rotation support member 60 to move in multiple directions. Since the configurations of the toy main body 20, the connection unit 30 and the rotation support member 60 are same as the earlier described configuration, the duplicate descriptions thereof will be omitted. The multiple-direction moving unit 80 will be described below.

Referring to FIGS. 11 and 12, the multiple-direction moving unit 80 according to a second exemplary embodiment of the present invention may be configured by including a first guide groove part 81 configured to rotate the main body block 61 to rotate in a circumferential direction and a first extension part 82.

The first extension part 82 is installed at a part of the outer circumference of the main body block 61 and is mounted in the first guide groove part 81. In addition, the first guide groove part 81 may be provided in the toy main body 2 in the circumferential direction of the body bock unit 61.

At this time, it is allowed that the first extension part 82 can move along the first guide groove part 81, and the main body block 61 can rotate by 360°. This configuration allows to rotate the body block 31 in upward and downward direction by 180° and rotate the body block 31 in a circumferential direction by 360°, thus obtaining the movements in multiple directions.

FIG. 12 is a view illustrating an assembled state according to a second exemplary embodiment of the present invention. First, the rotary shaft part 33 of the body block 31 is fixedly inserted in the rotary shaft support part 63 of the body block 61, and the first extension part 82 of the main body block 61 is mounted in the first guide groove part 81, and a ring type first fixing cover 83 is adhered to a fixing part 23 of the toy main body 20.

From FIGS. 13 through 19, it can be confirmed that there are provided various types of toy bodies 20 to which the second exemplary embodiment of the present invention applies. As illustrated in the corresponding drawings, the connection unit 30 and the multiple-direction moving unit 80 may be provided single or multiple on one surface of the toy main body 20. In case of the multiple provisions, a plurality of other toy bodies 20 may be connected to one surface of the toy main body 20 or the engaging force between the toy bodies 20 may be strengthened.

Next, referring to FIGS. 20 to 22, the multiple-direction moving unit 80 according to a third exemplary embodiment of the present invention may include a second guide groove part 85 allowing the body block 61 to move in the lengthwise direction of the toy main body 20, and a second extension part 86.

The second extension part 86 is installed along the outer circumference of the main body block 61 and is mounted in the second guide groove part 85. In addition, the second guide groove part 85 may be arranged in the lengthwise direction in the toy main body 20.

At this time, the second extension part 86 moves along the second guide groove part 85 and enables the main body block 61 to move from one side to the other side. This operation allows the body block 31 to rotate in upward and downward directions by 180° as well as allows the body block 31 to rotate in the circumferential direction by 360° or may allow to move in the lengthwise direction of the toy main body 20, thus obtaining the movements in multiple directions.

Here, FIG. 5 shows a configuration wherein the second guide groove part 85 is arranged in the lengthwise direction of the toy main body 20, however the second guide groove part 85 is basically arranged in a track shape in the toy main body 20.

Namely, the second guide groove part 85 is arranged in a track shape at the periphery of the main body block 61 in the toy main body 20. At this time, as illustrated in FIG. 20, the track shape may be arranged in the direction of a straight line of the toy main body 20 or as illustrated in FIG. 23, it may be arranged in a cross shape in the toy main body 20 or as illustrated in FIG. 24, it may be arranged in a circular shape or an elliptical shape in the toy main body 20.

In addition, as not illustrated in the drawing, the second guide groove part 85 may be formed in various curved shapes, for example, a ㄱ-shape, a ㄷ-shape, etc. Of course, it may be provided in a polygonal shape. Various shapes may be considered as long as other main body blocks 61 can move.

In this case, the second extension part 86 is installed along the outer circumference of the main body block 61 and is mounted in the second guide groove part 86. So, the main body block 61 may move along a track shape of the second guide groove part 85.

Therefore, the connection unit 30 in cooperation with the main body block 61 can move on the toy boy 20 in a straight line direction, a cross direction, a circular direction or an elliptical direction, so it is possible to move in multiple directions other toy bodies connected by the connection unit 30 as well as the corresponding toy main body 20 which is provided with the connection unit 30.

FIG. 21 is a view illustrating the assembled state according to the third exemplary embodiment of the present invention. First, the rotary shaft part 33 of the body block 31 is fixedly inserted in the rotary shaft support part 63 of the main body block 61, and the second extension parts 86 of a pair of the main body blocks 6 are adhered to each other, and are mounted in the second guide groove part 85, and then the ring type second fixing cover 87 is installed at the fixing part 23 of the toy main body 20.

Figure 25:
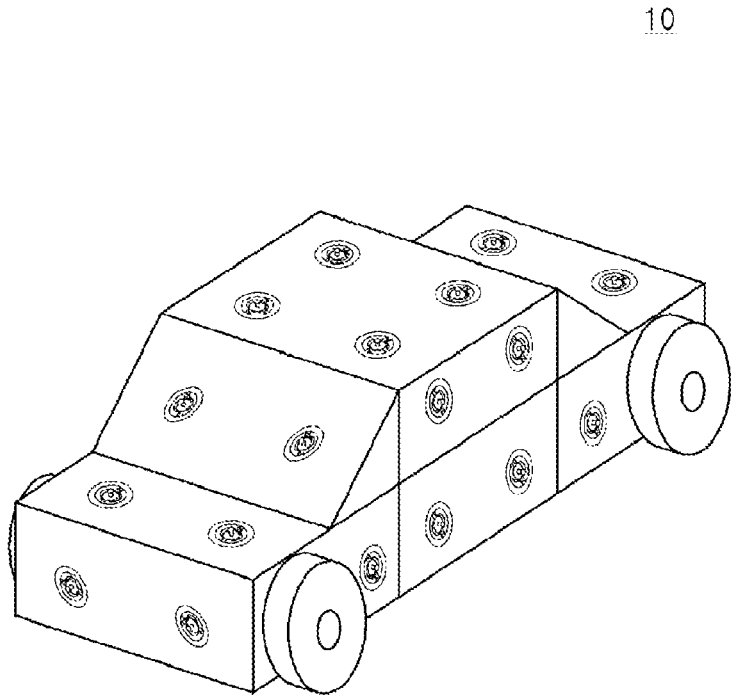
FIGS. 25 and 26 are perspective views of an exemplary embodiment wherein the present invention is embodied in a 3D structure.
Figure 26:
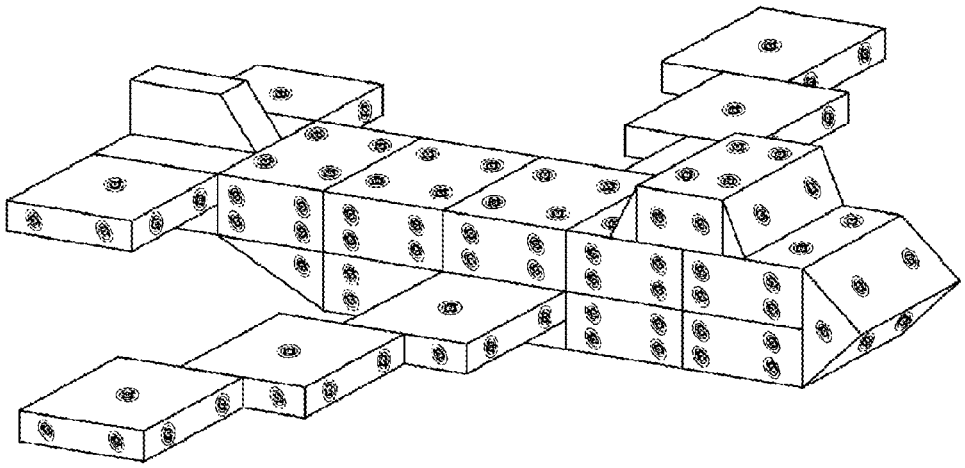
Figure 27:
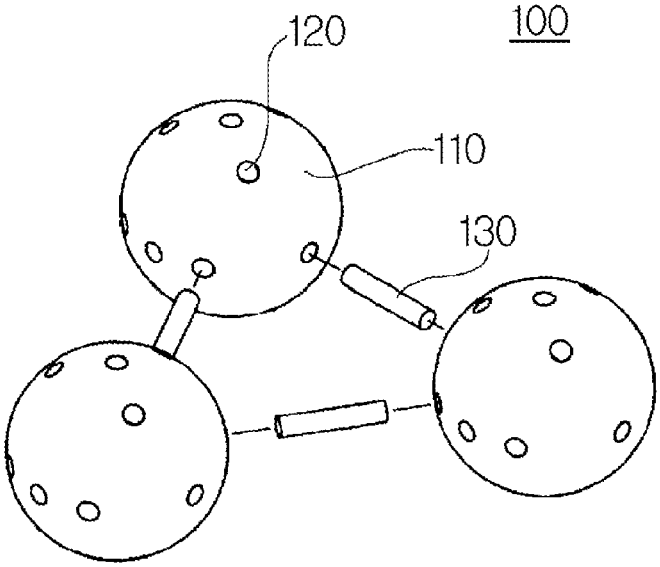
FIGS. 27, 28 and 29 are perspective views illustrating a conventional assembly-type toy.
Figure 28:
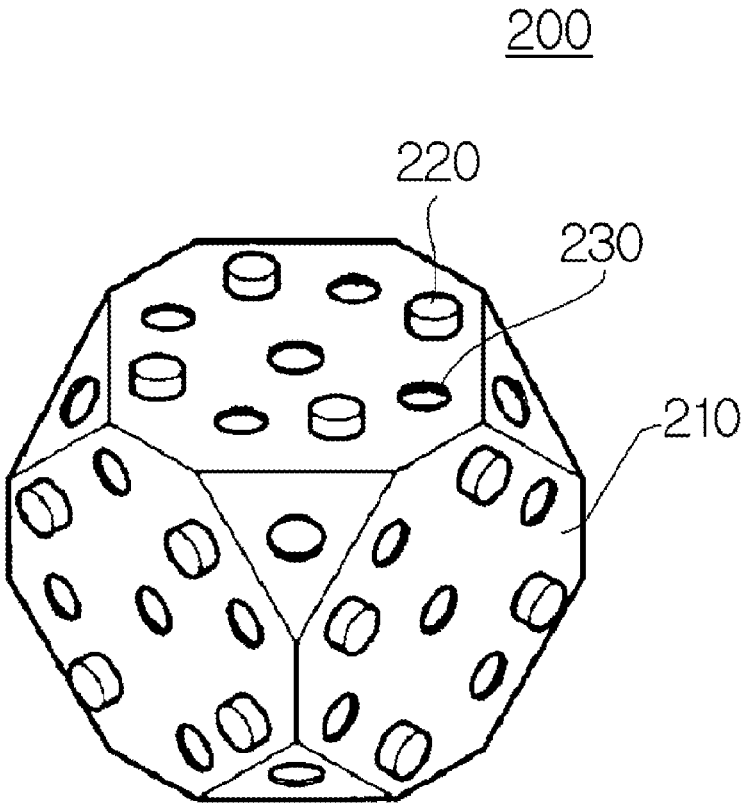
Figure 29:
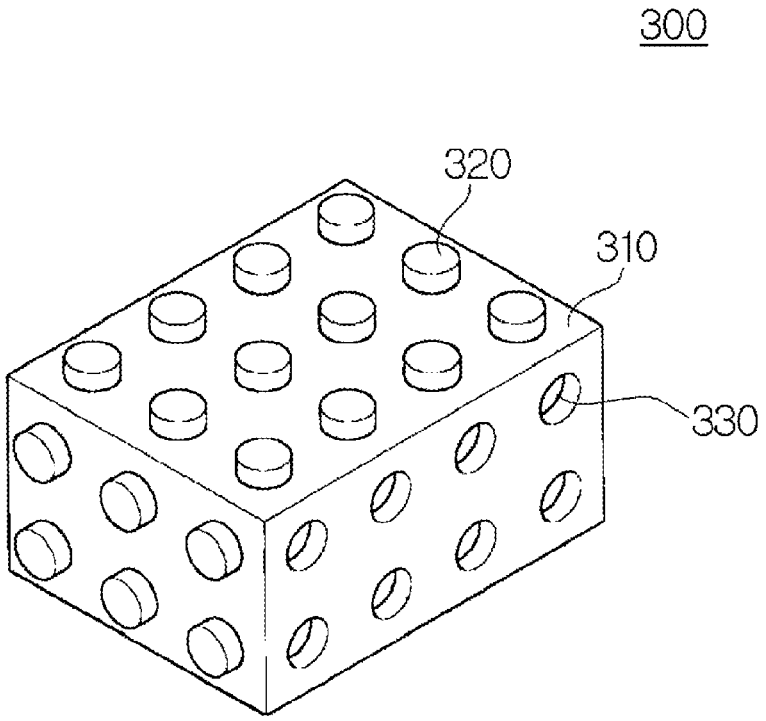

Meanwhile, FIGS. 25 and 26 are views illustrating a 3D configuration of the assembled toy according to an exemplary embodiment of the present invention, of which FIG. 25 is a view illustrating the configuration of a vehicle which is made through a relatively easier assembling procedure, and FIG. 26 is a view illustrating the configuration of an airplane which is made through a little complicated assembling procedures.

The exemplary embodiment of the present invention may apply to various types of toys. In this case, it is obvious that the assembling may apply to the configurations, for example, a vehicle, an airplane, etc. which may look more real than the 3D structure in FIGS. 25 and 26. At this time, the user may arrange the insertion part 40 of the connection unit 30 into the toy main body 20 so as to make the finally assembled 3D structure look clean.

In the present invention, it is possible to obtain the advantages wherein a plurality of toy blocks can be interconnected in such a way that one side of an engaging part provided in each toy block is configured to accommodate the engaging part of another toy block, and the other side thereof is configured to be inserted in the engaging part of another toy block, and at the same time, relative rotation is possible, and the engaging part which is not used for the engagement is arranged inside of the toy block, thus making clean the outer appearance of the finally assembled toy and obtaining a desired shape of the toy.

The above descriptions provide only the specific exemplary embodiments of the assembly-type toy.

Therefore, it is obvious that a person having ordinary skill in the art can easily recognize any substitutions and modifications in the present invention into various forms without departing from the spirits of the present invention recited in the claims below.

INDUSTRIAL APPLICABILITY

The present invention may be used for the sake of an assembly-type toy by which it is possible to assemble a finished toy product in a desired shape by engaging a plurality of toy blocks.

The invention claimed is:

1. An assembly-type toy, comprising:

a toy main body;

one or more than one connection means which is installed rotatable at the toy main body and includes an insertion part and an accommodation part which are provided for the sake of a connection and assembling of the toys; and a rotation support member which is provided at the toy main body so as to support rotations of the connection means, wherein the connection means includes a body block at one side of which the insertion part is formed, and at the other side of which the accommodation part is formed, the body block including a first curved part which is curved to bulge in a circumferential direction, and wherein the rotation support member includes a main body block which at least covers partially a circumference of the body block and is mounted in a engaging part of the toy main body, a inner surface of the main body block including a second curved part which is curved in a concave shape corresponding to the configuration of the first curved part.

2. The toy of claim 1, wherein a connection and assembling of the toys can be obtained in such a way that the insertion part of the connection means is inserted in the accommodation part of the connection means provided at another toy or the insertion part of the connection means provided at another toy is inserted in the accommodation part of the connection means.

3. The toy of claim 1, wherein the connection means includes a rotary shaft part which is provided at both sides of the body block and is inserted in the rotation support member, thus enabling the body block to rotate.

4. The toy of claim 1, wherein the insertion part includes a protrusion block which protrudes from one side of the body block, and the accommodation part includes an engaging groove formed at the other side of the body block for thereby receiving the protrusion block.

5. The toy of claim 4, wherein the insertion part includes a cap member provided at an outer end of the protrusion block, and the accommodation part includes an engaging shoulder part which is provided at an inner side of the engaging groove, so the cap member is caught thereby.

6. The toy of claim 5, wherein the cap member is made of an elastic material for the sake of easier assembling to or easier separation from the engaging shoulder part.

7. The toy of claim 6, further comprising:

a first magnetic force member which is installed at the cap member so as to form one magnetic pole in the magnetic force; and a second magnetic force member which is installed at the engaging shoulder part so as to form the other magnetic pole which is different from that of the first magnetic force member, in order to cooperate with the first magnetic force member.

8. The toy of claim 3, wherein the rotation support member includes a rotary shaft support part which is provided on a contact surface with the body block in the main body block and into which the rotary shaft part is inserted and which supports the rotations of the body block.

9. The toy of claim 1, further comprising:

a multiple-direction moving means which is disposed between the rotation support member and the toy main body so as to enable the rotation support member to move in multiple directions.

10. The toy of claim 9, wherein the multiple-direction moving means includes:

a first guide groove part which is disposed in a circumferential direction of the main body block in the toy main body; and a first extension part which is installed at an outer circumference of the main body block and is mounted in the first guide groove part and moves along the first guide groove part and enables the main body block to rotate in a circumferential direction.

11. The toy of claim 9, wherein the multiple-direction moving means includes:

a second guide groove part which is provided in a track shape at a periphery of the main body block in the toy main body; and a second extension part which is installed along an outer circumference of the main body block and is mounted in the second guide groove part and enables the main body block to move along a track shape of the second guide groove part.

12. The toy of claim 4, wherein the rotation support member includes a rotary shaft support part which is provided on a contact surface with the body block in the main body block and into which the rotary shaft part is inserted and which supports the rotations of the body block.

13. The toy of claim 5, wherein the rotation support member includes a rotary shaft support part which is provided on a contact surface with the body block in the main body block and into which the rotary shaft part is inserted and which supports the rotations of the body block.

14. The toy of claim 6, wherein the rotation support member includes a rotary shaft support part which is provided on a contact surface with the body block in the main body block and into which the rotary shaft part is inserted and which supports the rotations of the body block.

15. The toy of claim 7, wherein the rotation support member includes a rotary shaft support part which is provided on a contact surface with the body block in the main body block and into which the rotary shaft part is inserted and which supports the rotations of the body block.

* * * * *